US006439676B1

(12) United States Patent
Badonič

(10) Patent No.: US 6,439,676 B1
(45) Date of Patent: Aug. 27, 2002

(54) CABINET FOR STORING SOILED CLOTHES PREPARATORY TO WASHING

(76) Inventor: Miroslav Badonič , Hlavná 15, 040 01 Košice (SK)

( * ) Notice: Subject to any disclaimer, the term of this patent is extended or adjusted under 35 U.S.C. 154(b) by 0 days.

(21) Appl. No.: 09/582,698

(22) PCT Filed: Nov. 3, 1999

(86) PCT No.: PCT/SK99/00016

§ 371 (c)(1),
(2), (4) Date: Oct. 17, 2000

(87) PCT Pub. No.: WO00/26463

PCT Pub. Date: May 11, 2000

(30) Foreign Application Priority Data

Nov. 3, 1998 (SK) ..... 1506-98

(51) Int. Cl.[7] ..... A47B 81/00

(52) U.S. Cl. ..... 312/212; 312/247; 312/248; 312/283

(58) Field of Search ..... 312/212, 245, 312/246, 243, 248, 290, 249.7, 249.1, 283, 286; 232/1 B, 1 R

(56) References Cited

U.S. PATENT DOCUMENTS

| | | | | | |
|---|---|---|---|---|---|
| 1,590,793 | A | * | 6/1926 | Stephens | 312/245 X |
| 2,104,523 | A | * | 1/1938 | Lichtenstein | 312/245 X |
| 2,629,644 | A | * | 2/1953 | Heys | 312/286 |
| 2,854,307 | A | * | 9/1958 | Londeree et al. | 312/247 |
| 2,895,782 | A | * | 7/1959 | Fragale | 312/290 |
| 3,352,614 | A | * | 11/1967 | Andersen | 312/246 X |
| 4,141,612 | A | * | 2/1979 | Rowe | 312/245 |
| 4,903,866 | A | * | 2/1990 | Loew | 312/248 X |
| 5,026,129 | A | * | 6/1991 | Merl | 312/248 X |
| 5,228,763 | A | * | 7/1993 | Gingold | 312/247 X |
| 5,518,309 | A | * | 5/1996 | St-pierre | 312/248 X |
| 5,547,271 | A | * | 8/1996 | Rydell | 312/211 |
| 5,700,293 | A | | 12/1997 | Rydell | |
| 5,836,661 | A | * | 11/1998 | Oldorf | 312/290 X |

FOREIGN PATENT DOCUMENTS

| | | | | |
|---|---|---|---|---|
| DE | 28 23 955 | | 12/1979 | |
| FR | 1 235 102 | | 10/1960 | |
| JP | 05176815 | * | 7/1993 | 312/247 |
| JP | 05228034 | * | 9/1993 | 312/247 |

* cited by examiner

*Primary Examiner*—Lanna Mai
*Assistant Examiner*—Hanh V. Tran
(74) *Attorney, Agent, or Firm*—Burns, Doane, Swecker & Mathis, LLP

(57) ABSTRACT

A clothes storing cabinet is adapted to hold soiled clothes preparatory to washing. The cabinet includes a body forming a plurality of chambers. The body forms a filling opening and a discharge opening for each chamber. The body is movable up and down between a lower clothes-loading position, and a raised clothes-discharging position. This movement can be achieved by sliding the body up and down along a vertical path, or, swinging the body by ninety degrees about a horizontal axis. When the body is in a raised clothes-discharging position, closures attached to the body can be swung open to enable clothes to gravitate from the respective chambers.

9 Claims, 5 Drawing Sheets

CABINET FOR STORING SOILED CLOTHES PREPARATORY TO WASHING

BACKGROUND

The invention refers to construction of a storing cabinet for soiled clothes in preparation for washing and to the placement and manipulation of the cabinet for the storing, sorting and washing of soiled clothes, especially for storing and washing of small quantities.

PRIOR ART

For clothes storing before washing, heretofore miscellaneous baskets, bags and chests are used, which have only one internal capacity and are placed on a floor or are fastened on a wall near to a floor area. The disadvantage of such storing of clothes for washing is the impossibility of sorting and dosing before washing. A further disadvantage is that it requires considerable floor area in bathrooms, cloakrooms, passages or laundries and the manipulation with clothes stored in this way requires their transfer to washing equipment.

SUMMARY OF THE INVENTION

The invention pertains to a clothes storing cabinet adapted to hold soiled clothes preparatory to washing. The cabinet includes a body and a plurality of closures attached to the body. The body forms a plurality of chambers disposed alongside one another. The body includes filling openings communicating with respective chambers for enabling soiled clothes to be loaded into selected chambers. The closures are attached to the body beneath respective chambers. Each closure is arranged to be swung from a closed position to an opened position to permit unloading of clothes from the respective chamber. The body, together with the chambers, is movable up and down between a lowered clothes-loading position and a raised clothes-discharging position. The body defines an upper portion when in its clothes-loading position, and the filling openings are disposed in that upper portion. The body defines a lower portion when in its clothes-discharging position, with the closures arranged on that lower portion. The clothes-discharging position of the body is superimposed over the clothes-loading position of the body.

The clothes storing cabinet according to this invention facilitates optimal storage and sorting of clothes before washing and lowers the physical effort involving manipulation of the clothes and removes objects from floors to promote tidiness.

DESCRIPTION OF THE DRAWINGS

The invention is particularly elucidated by means of drawings, wherein.

DETAILED DESCRIPTION OF PREFERRED EMBODIMENTS OF THE INVENTION

First Embodiment

Figure 1:
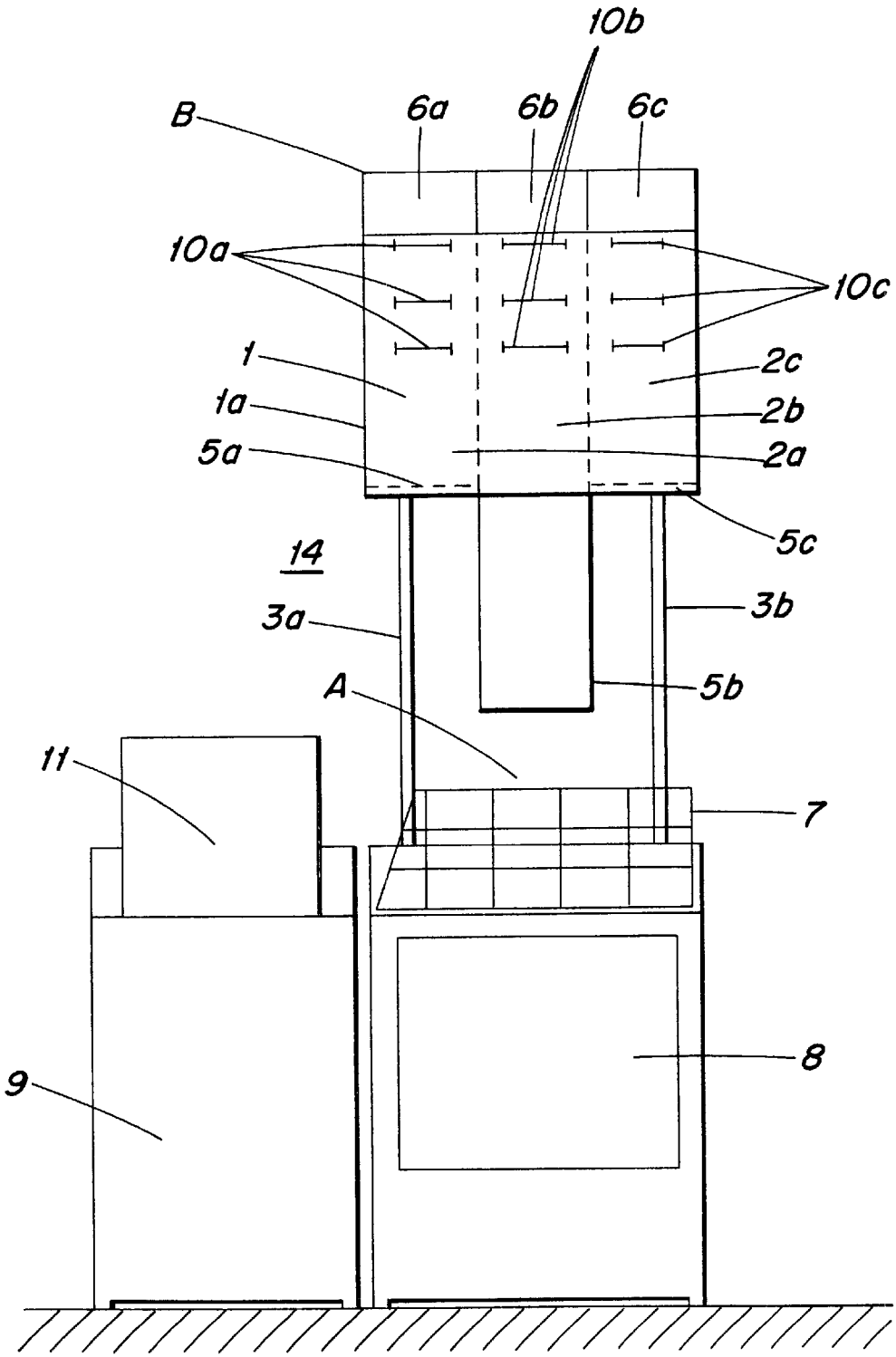
FIG. 1 is illustrated a front view of a first embodiment of the clothes storing cabinet according to the invention and its positioning on a wall above the drier close to a washing machine, the cabinet disposed in a raised clothes-discharging state.
Figure 2:
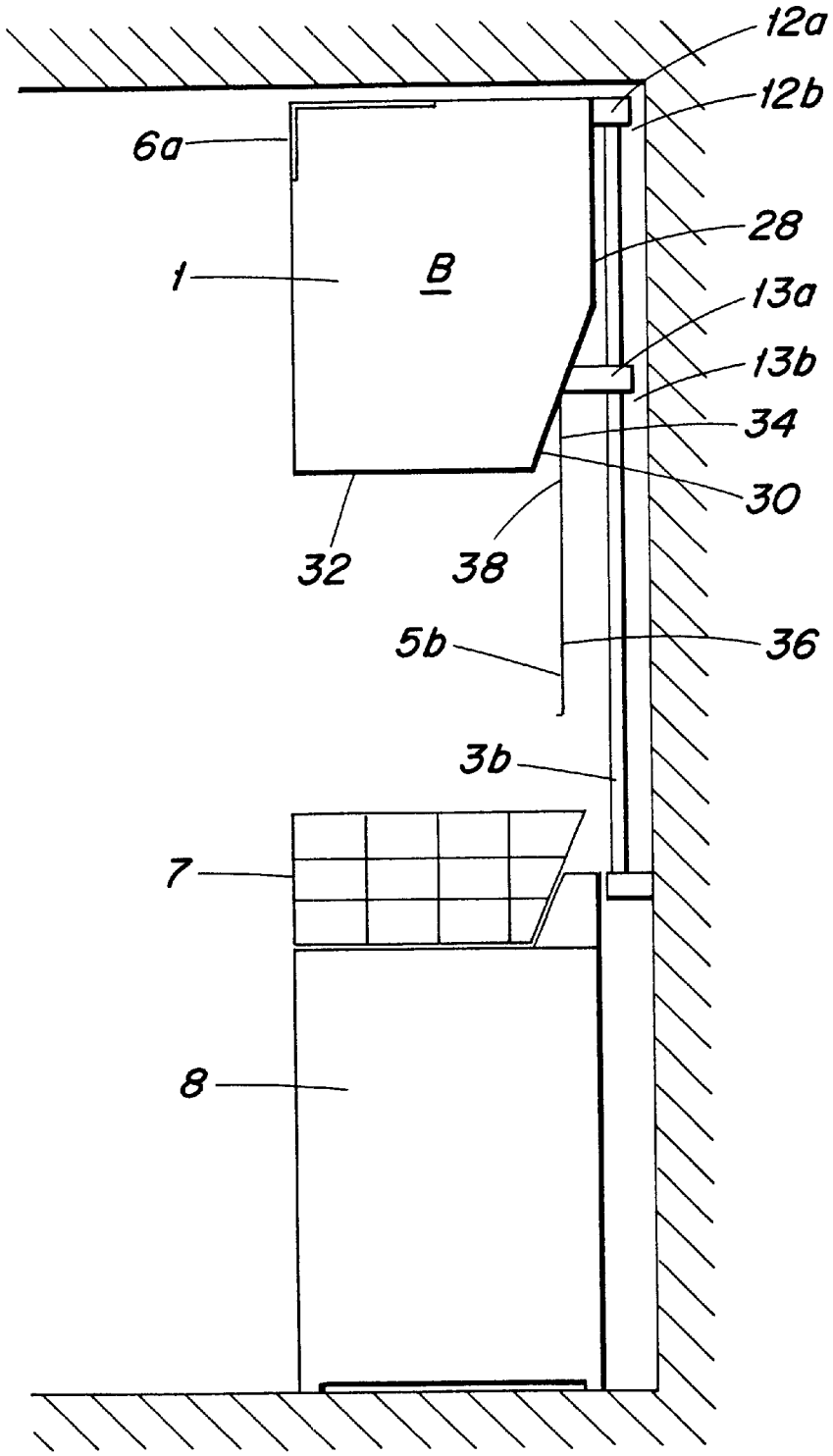
FIG. 2 is illustrated a lateral view of the clothes storing cabinet shown in FIG. 1.
Figure 3:
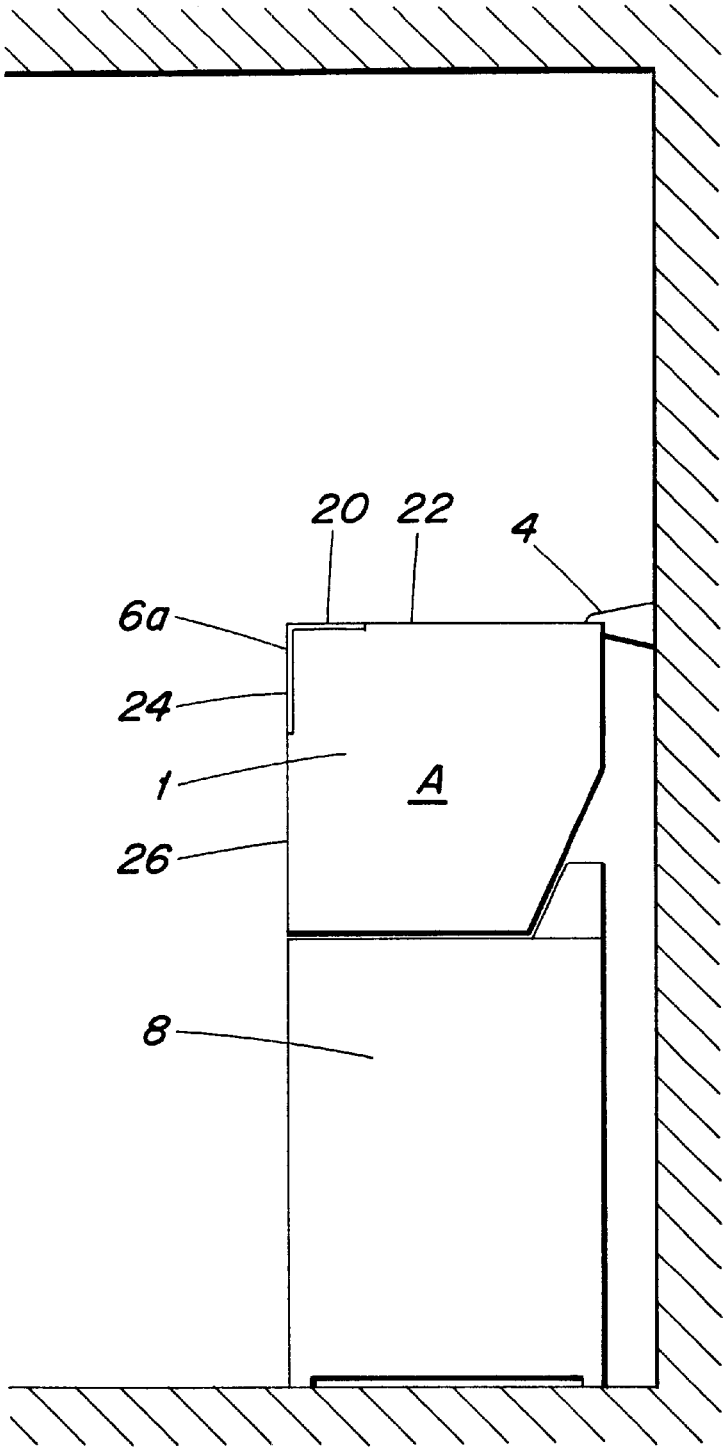
FIG. 3 is illustrated a lateral view of a second embodiment of the clothes storing cabinet on a wall above a drier in a lowered clothes-loading state.
Figure 4:
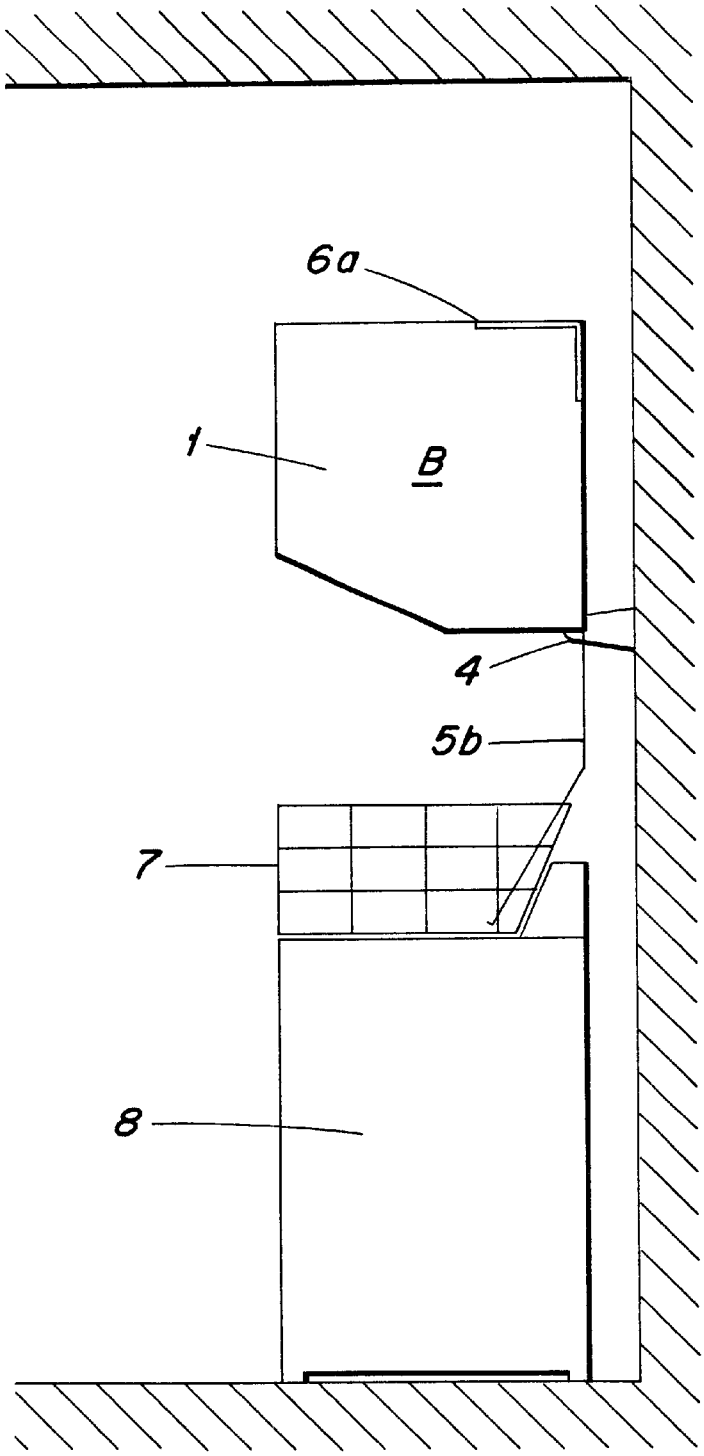
FIG. 4 is illustrated a lateral view of the clothes storing cabinet of FIG. 3 in an upper position.
Figure 5:
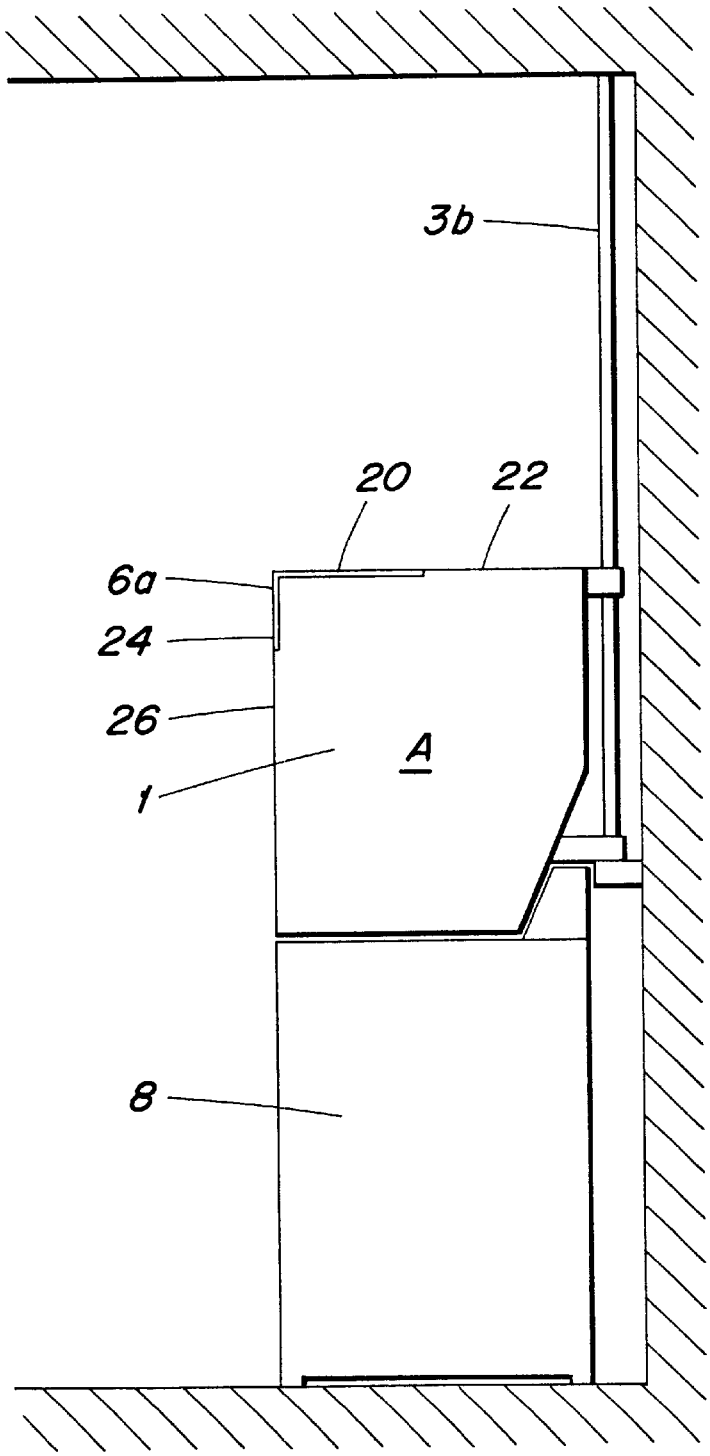
FIG. 5 is illustrated a lateral view of the clothes storing cabinet of FIG. 2 in a lowered state.

The clothes storing cabinet according to the invention illustrated in FIGS. 1, 2 and 5 consists of body 1*a* in which three chambers for clothes, the left chamber 2*a*, middle chamber 2*b* and right chamber 2*c* are made. In an upper part of the left chamber 2*a* a left filling opening 6*a* is made, in an upper part of the middle chamber 2*b* a middle filling opening 6*b* is made and in an upper part of the right chamber 2*c* a right filling opening 6*c* is made. In a lower part of the left chamber 2*a* a left bottom closure 5*a* is positioned, in a lower part of the middle chamber 2*b* a middle bottom closure 5*b* is positioned and in a lower part of the right chamber 2*c* a right bottom closure is positioned. Formed on a front portion of the body are: capacity marks 10*a* of the left chamber, capacity marks 10*b* of the middle chamber and capacity marks 10*c* of the right chamber. Formed on a rear portion 1*a* of the cabinet are two upper grips 12*a*, 12*b* and two lower grips 13*a*, 13*b*, which are slidable on a right guide rod 3*b* and left guide rod 3*a*, whereby the cabinet is vertically movable in an area above a drier 8 or a washing machine 9, whereby the guide rods 3*a* and 3*b* are attached on wall above drier 8 or the washing machine 9.

As can be seen in FIG. 2, each of the filling openings 6*a*, 6*b*, 6*c* includes a top part 20 formed in a top wall 22 and a front part 24 formed in a front wall 26 of the cabinet. The top part 20 extends rearwardly for only a portion of the extent of the top wall 22, and the front part 24 extends downwardly for only a portion of the extent of the front wall 26.

What is claimed is:

1. A clothes storing cabinet adapted to hold soiled clothes preparatory to washing, comprising:

a body forming a plurality of chambers disposed alongside one another, the body including filling openings communicating with respective chambers for enabling soiled clothes to be loaded into selected chambers; and a plurality of closures attached to the body beneath undersides of respective chambers, each closure arranged to be swung downwardly from a closed position to an open position to permit unloading of clothes from the respective chamber;

the body, together with the chambers, being mounted for up-and-down sliding movement between a lowered clothes-loading position and a raised clothes-discharging position;

the body defining an upper portion when in its clothes-loading position, and the filling openings being disposed in that upper portion;

the body defining a lower portion when in its clothes-discharging position, with the closures arranged on that lower portion;

the clothes-discharging position of the body being superimposed over the clothes-loading position of the body;

each of the closures arranged to underlie substantially the entire underside of its respective chamber and mounted for swinging movement about a substantially horizontal axis disposed adjacent a rear portion of the body, wherein substantially the entire underside is uncovered when the closure is in its open position.

2. The clothes storing cabinet according to claim 1 wherein when the body is in its clothes-loading position, the upper portion comprises a top wall and a front wall, and each of the filling openings includes a front part and a top part disposed in the front wall and the top wall, respectively, the front part extending for only a portion of a downward extent of the front wall, and the top part extending for only a portion of a rearward extent of the top wall.

3. The clothes storing cabinet according to claim 1, wherein when the body is in its clothes-discharging position, the underside of the chamber includes a substantially horizontal section.

4. The clothes storing cabinet according to claim 1 wherein the plurality of chambers includes a left chamber, a right chamber, and a middle chamber disposed between the left and right chambers.

5. The clothes storing cabinet according to claim 1 wherein when the body is in its clothes-loading position it defines a front wall having sets of vertically spaced indicator marks, each set of marks disposed in front of a respective chamber, the marks in each set representing respective degrees of filling of its chamber.

6. A clothes storing cabinet adapted to hold soiled clothes preparatory to washing, comprising:

a body forming a plurality of chambers disposed alongside one another, the body including filling openings communicating with respective chambers for enabling soiled clothes to be loaded into selected chambers; and a plurality of closures attached to the body beneath undersides of respective chambers, each closure arranged to be swung downwardly from a closed position to an open position to permit unloading of clothes from the respective chamber;

the body, together with the chambers, being mounted for up-and-down sliding movement between a lowered clothes-loading position and a raised clothes-discharging position;

the body defining an upper portion when in its clothes-loading position, and the filling openings being disposed in that upper portion;

the body defining a lower portion when in its clothes-discharging position, with the closures arranged on that lower portion;

the clothes-discharging position of the body being superimposed over the clothes-loading position of the body;

wherein the body is arranged for substantially ninety degree swinging movement between the clothes-loading and clothes-discharging positions about a fixed substantially horizontal axis.

7. The clothes storing cabinet according to claim 6 wherein when the body is in its clothes-discharging position, the bottom portion of the body includes a substantially horizontal, downwardly open section beneath each chamber, wherein each closure is configured to close the substantially horizontal section.

8. The clothes storing cabinet according to claim 7 wherein each of the closures is mounted for swinging movement about a substantially horizontal axis disposed adjacent a rear portion of the body, the horizontal axos being common to all of the closures.

9. The clothes storing element according to claim 6 wherein when the body is in its clothes-discharging position, a rear portion of the body includes an inclined section inclined downwardly and forwardly and intersecting the generally horizontally extending section; each of the closures including a rear part and a front part joined to one another by a hinge, the rear part joined to the body by a hinge, wherein the rear part of each closure is arranged to underlie the inclined section of the rear portion of a respective chamber, and the front part of each closure is arranged to underlie the substantially horizontal section of the respective chamber.

* * * * *